US007568925B2

(12) United States Patent
Ciriello et al.

(10) Patent No.: US 7,568,925 B2
(45) Date of Patent: Aug. 4, 2009

(54) ELECTRIC CONNECTOR WITH AN ACTUATOR HAVING A TOOTHED COUPLING

(75) Inventors: Tommasino Ciriello, Veneria (IT); Giovanni Stella, Turin (IT)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/884,581

(22) PCT Filed: Jan. 31, 2006

(86) PCT No.: PCT/EP2006/000844

§ 371 (c)(1),
(2), (4) Date: Aug. 16, 2007

(87) PCT Pub. No.: WO2006/087097

PCT Pub. Date: Aug. 24, 2006

(65) Prior Publication Data

US 2008/0214039 A1 Sep. 4, 2008

(30) Foreign Application Priority Data

Feb. 16, 2005 (IT) ..... TO2005A0089

(51) Int. Cl.
*H01R 13/62* (2006.01)

(52) U.S. Cl. ..... 439/157

(58) Field of Classification Search ..... 439/157, 439/372

See application file for complete search history.

(56) References Cited

U.S. PATENT DOCUMENTS

| | | | | |
|---|---|---|---|---|
| 5,681,175 | A * | 10/1997 | Busse et al. | 439/157 |
| 6,193,530 | B1 * | 2/2001 | Sakurai et al. | 439/157 |
| 6,305,957 | B1 | 10/2001 | Fink et al. | 439/157 |
| 6,345,995 | B1 * | 2/2002 | Bigotto et al. | 439/157 |
| 6,702,597 | B2 * | 3/2004 | Pade | 439/157 |
| 6,824,406 | B1 | 11/2004 | Sharples et al. | 439/157 |

FOREIGN PATENT DOCUMENTS

| | | |
|---|---|---|
| EP | 0 363 804 | 4/1990 |
| EP | 1 396 910 A1 | 3/2004 |

* cited by examiner

*Primary Examiner*—Tho D Ta
(74) *Attorney, Agent, or Firm*—Harrington & Smith, PC

(57) ABSTRACT

An electric connector has an insulating casing defining a number of cavities for housing respective electric terminals and having axes parallel to a first direction (A) in which the connector is connected to a complementary connector; a slide fitted to the casing to slide in a second direction (B) perpendicular to the first direction (A), and having camtype first constraint means for receiving second constraint means on said complementary connector to produce a relative coupling movement between the connectors in the first direction (A) when the slide translates in the second direction (B); and an operating lever rotating about an axis (C) perpendicular to the first and second direction (A, B), and activated selectively to translate the slide in the second direction (B); the lever is hinged to the slide at the aforementioned axis (C), and actuating means are provided to move the axis (C) and the slide in the second direction (B) when the lever is operated.

6 Claims, 4 Drawing Sheets

ELECTRIC CONNECTOR WITH AN ACTUATOR HAVING A TOOTHED COUPLING

The present invention relates to an electric connector, and in particular, though not exclusively, to an automotive electric plug connector connectable to a complementary electric socket connector to form an electric connecting unit with a large number of pin contacts, of the type used, for example, to connect a vehicle electric system to an electronic central control unit.

Connecting units of the above type are known, wherein the connectors comprise respective insulating casings defining respective numbers of cavities for housing mutually connectable male and female electric terminals respectively.

Connecting units of this sort normally comprise a lever-slide device which, once the plug and socket connectors are brought together, provides for connecting the connectors with a minimum amount of effort.

The lever-slide device substantially comprises a slide fitted inside the plug connector casing to slide in a direction perpendicular to the connection direction of the connectors; and an operating lever hinged to the plug connector casing and connected to the slide.

In a fairly commonly used embodiment, the slide is C-shaped, and comprises an end wall perpendicular to the sliding direction; and two lateral walls extending perpendicularly from respective opposite end edges of the end wall, and which slide along respective lateral walls of the plug connector casing. Each lateral wall of the slide has a number of cam grooves, which are engaged by respective pegs on the outside of the socket connector to produce a relative coupling movement between the plug and socket connectors in the connection direction, when the slide translates in the sliding direction.

The slide is normally retained, by releasable retaining means, e.g. click-on retaining members, in a preassembly position partly inserted inside the plug connector casing, and is moved into a fully-inserted position inside the casing by rotating the operating lever about its hinge axis from a first to a second operating position.

Though functionally valid, plug connectors of the above type, with lever-slide devices, still leave room for further improvement.

In particular, though the lever-slide device provides for reducing the effort required to connect the connectors, and therefore the relative terminals, a certain amount of effort on the part of the user is still required.

It is an object of the present invention to provide an electric connector connectable to a complementary connector with less effort required as compared with known connectors, and which, to do so, involves no increase in overall size.

According to the present invention, there is provided an electric connector as defined in Claim 1.

A preferred, non-limiting embodiment of the present invention will be described by way of example with reference to the accompanying drawings, in which.

Figure 1:
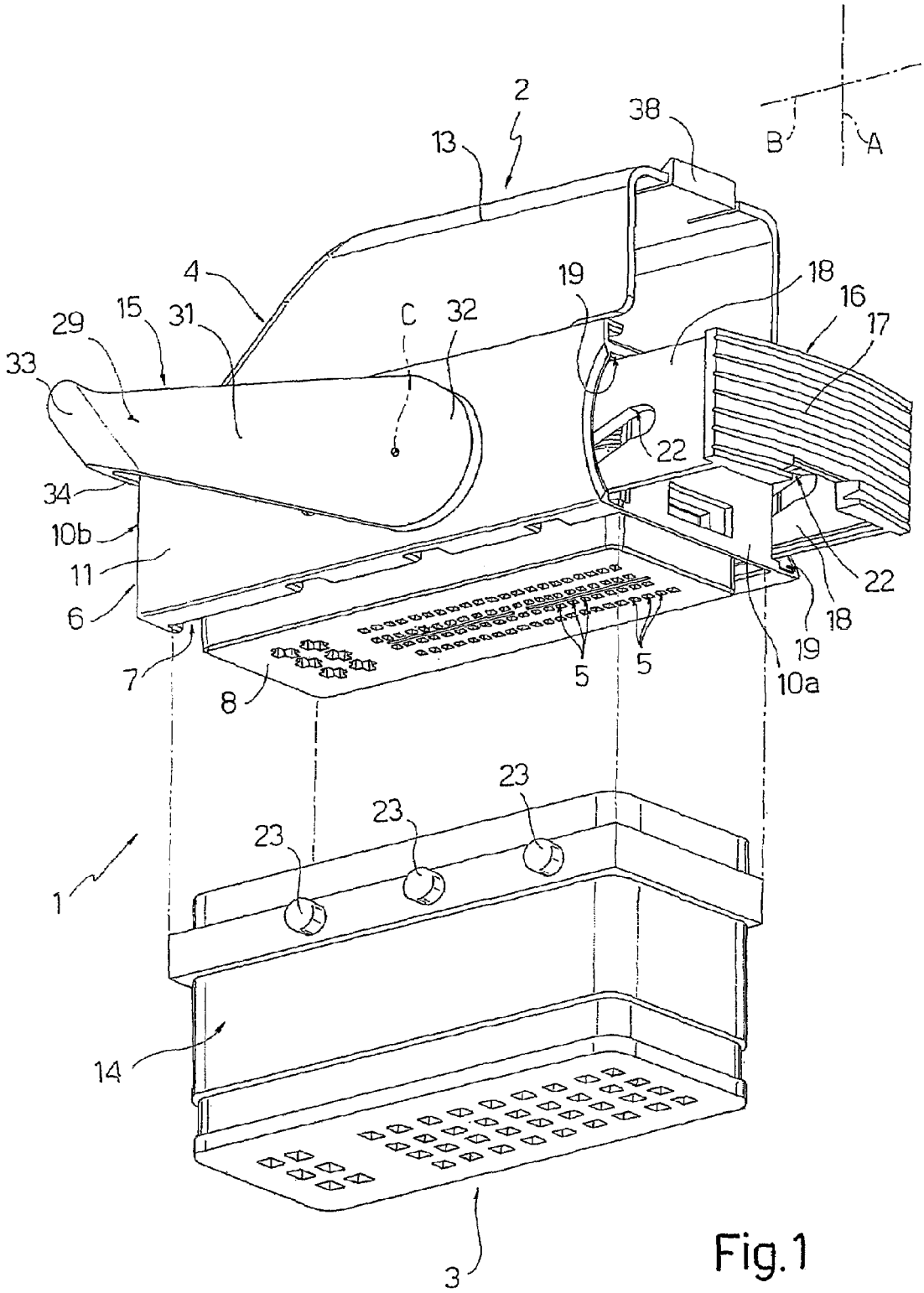
FIG. 1 shows an exploded view in perspective of an electric connecting unit comprising an electric plug connector in accordance with the present invention, and a complementary electric socket connector.

Number 1 in FIG. 1 indicates as a whole an electric connecting unit with a large number of pin contacts, in particular for connecting an electronic central control unit (not shown) to an electric system (not shown) of a vehicle (not shown).

Unit 1 comprises a first plug connector 2 and a second socket connector 3 connectable to each other in a direction A.

Connector 2 (FIGS. 1-4) according to the present invention comprises an insulating casing 4 made of plastic material and defining a number of cavities 5 having axes parallel to direction A and for housing respective female electric terminals (not shown) retained in known manner inside cavities 5 and connected to respective electric cables (not shown).

Casing 4 comprises a hollow, substantially parallelepiped-shaped main body 6 defining an end opening 7 for insertion of connector 3, and housing a substantially parallelepiped-shaped block 8 for supporting the female terminals and in which cavities 5 are formed.

More specifically, main body 6 comprises two, respectively front and rear, end walls 10*a*, 10*b*; and two lateral walls 11 perpendicular to end walls 10*a*, 10*b* and defining, together with end walls 10*a*, 10*b*, opening 7 for receiving connector 3.

Casing 4 also comprises an outer shell 13 fitted to main body 6 on the opposite side to opening 7, and through which extend the electric cables for connection to the female terminals supported by block 8.

Connector 3 (FIG. 1), described below only as required for a clear understanding of the present invention, comprises a hollow, substantially parallelepiped-shaped insulating casing 14 conveniently formed in one piece with the housing (not shown) of the electronic central control unit, and housing a number of known male electric terminals (not shown) extending parallel to direction A and connected to respective known electric cables (not shown). Casing 14 defines a compartment for receiving block 8 of connector 2, into which project respective contact portions of the male terminals.

Unit 1 also comprises a lever-slide device 15 for connecting connectors 2 and 3 with a minimum amount of manual force.

Device 15 comprises a slide 16 which slides inside casing 4, and is movable with respect to casing 4 in a direction B perpendicular to direction A and to end walls 10*a*, 10*b* of main body 6. Slide 16 (FIG. 4) is substantially C-shaped, and comprises an end wall 17 perpendicular to direction B; and two lateral walls 18 extending perpendicularly from respective opposite lateral edges of end wall 17 and parallel to directions A and B. Lateral walls 18 of slide 16 fit through respective lateral end openings 19 in end wall 10*a*, and slide between block 8 and respective opposite lateral walls 11 of main body 6 of casing 4. Main body 6, block 8, and lateral walls 18 of slide 16 define a compartment for receiving casing 14 of connector 3, and therefore the region in which connector 2 is connected to connector 3.

Each lateral wall 18 has a number of cam grooves 22—three in the example shown (FIGS. 2 and 4)—which cooperate with respective pegs 23 on the outside of casing 14 to produce a relative coupling movement between connectors 2 and 3 in direction A, when slide 16 translates inwards of casing 4 in direction B. The shape of grooves 22 is known from EP-A-363804, and therefore only described briefly.

Figure 2:
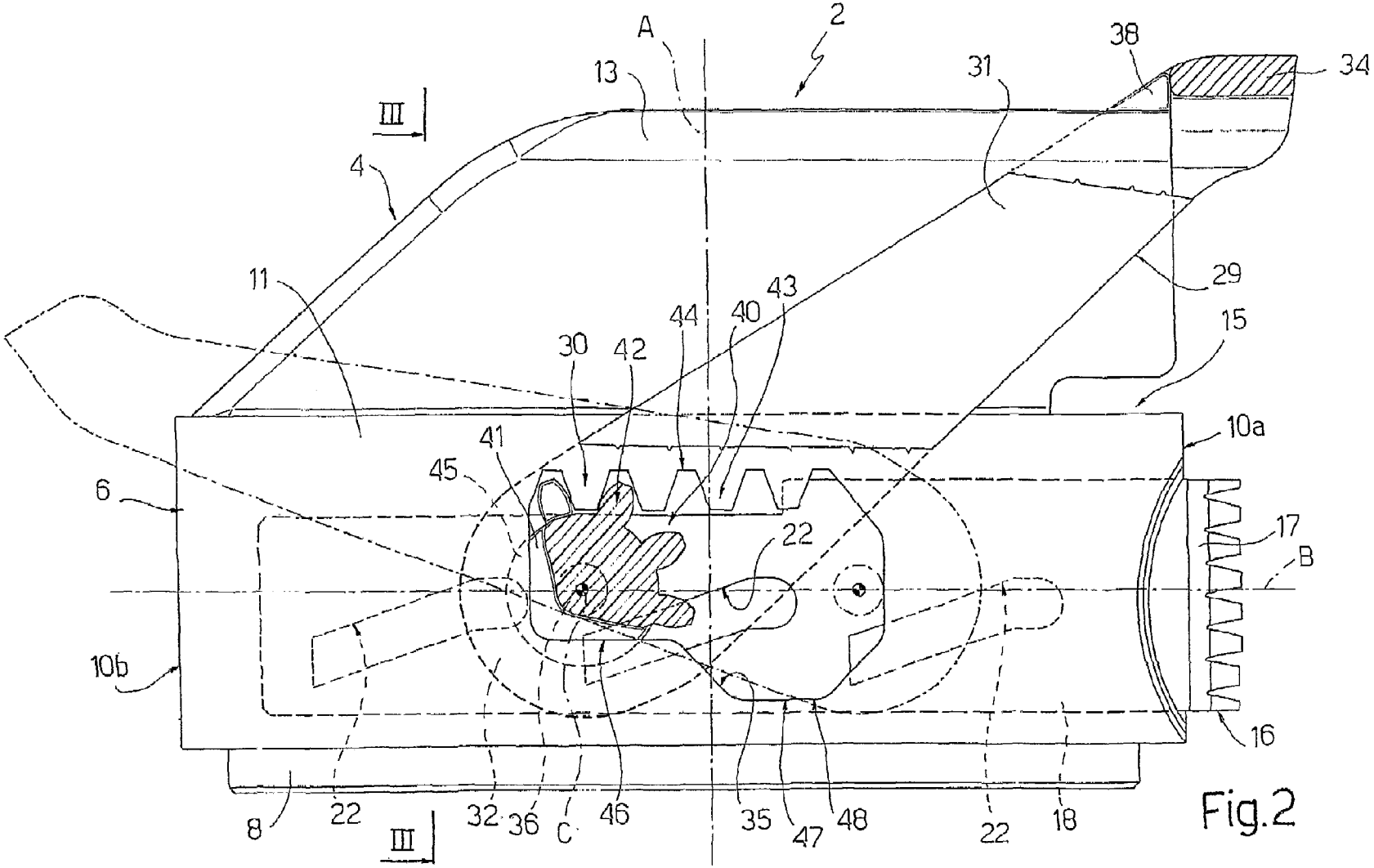
FIG. 2 shows a larger-scale, partly sectioned side view of the FIG. 1 electric plug connector in two different operating positions.
Figure 3:
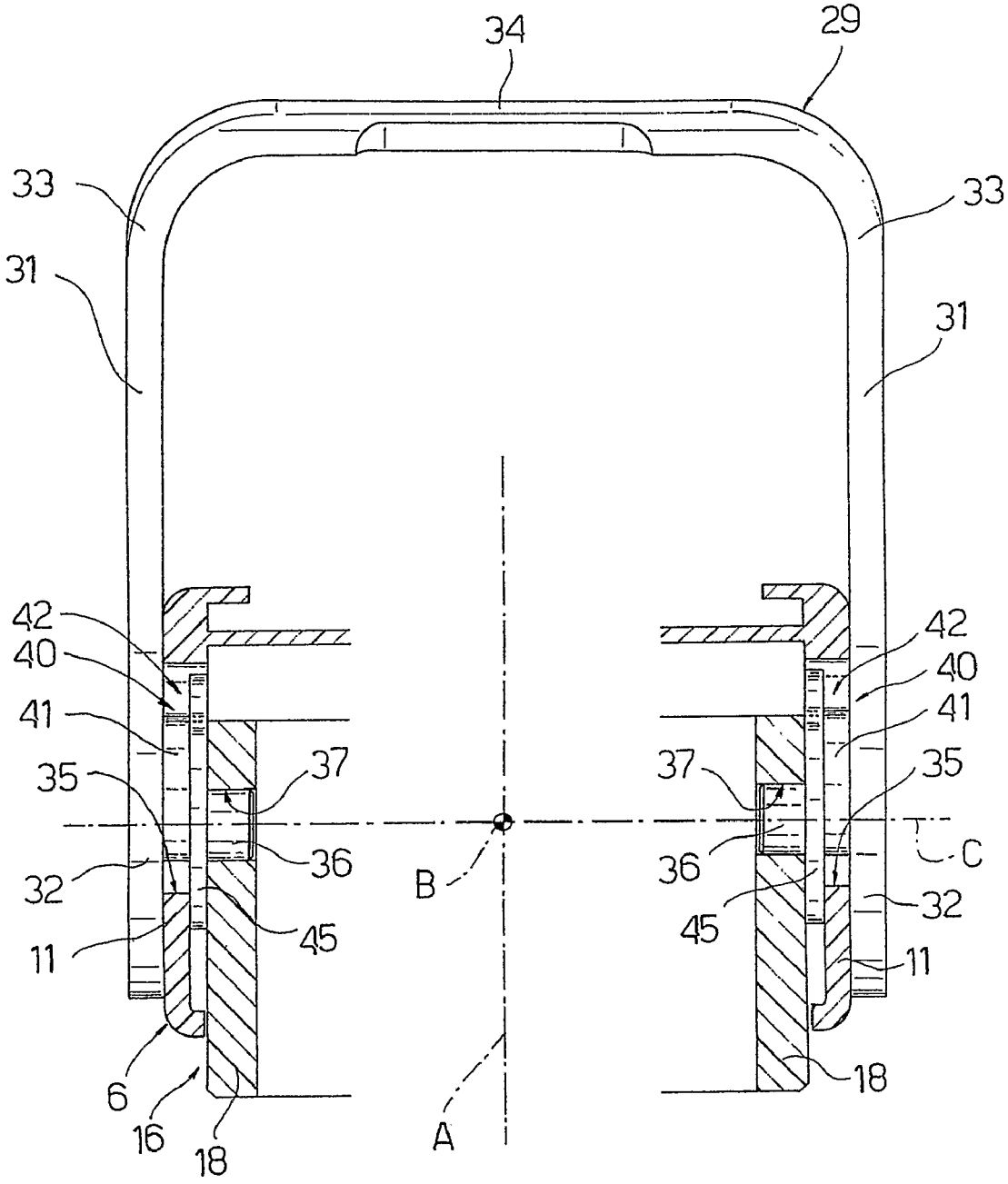
FIG. 3 shows a larger-scale section, with parts removed for clarity, along line III-III in FIG. 2.
Figure 4:
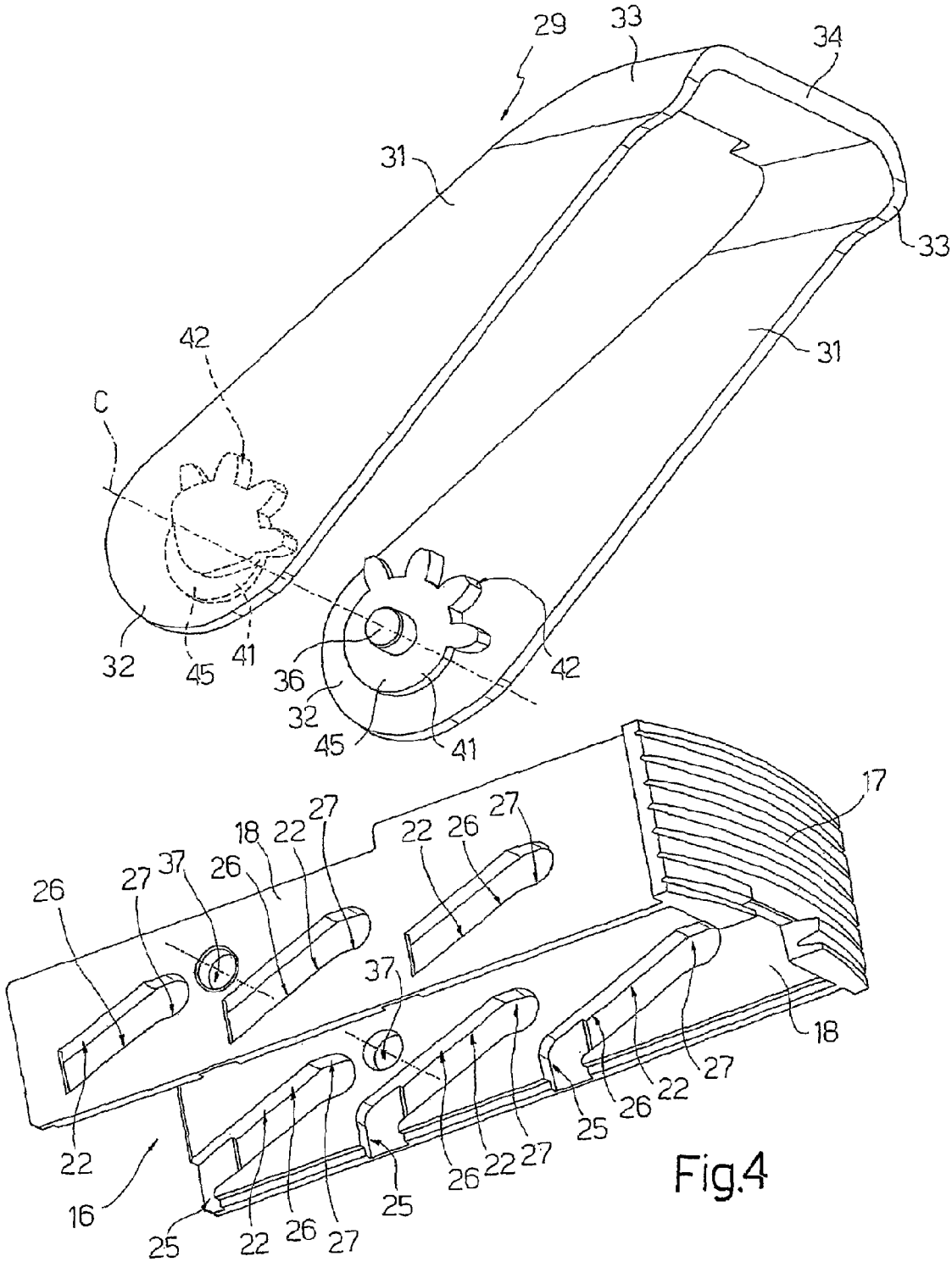
FIG. 4 shows a larger-scale, exploded view in perspective of two component parts of the FIG. 1 electric plug connector.

With particular reference to FIGS. 2 and 4, each groove 22 comprises an inlet portion 25, for relative peg 23, extending parallel to direction A and close to opening 7; an intermediate portion 26 sloping with respect to directions A and B; and an end portion 27 parallel to direction B and defining a stop for peg 23.

Before connectors 2 and 3 are connected, slide 16 is normally maintained, by known releasable retaining members (not shown), in a preassembly position (FIG. 1), in which it is partly extracted by a given amount from main body 6, with end wall 17 and part of lateral walls 11 projecting from main body 6. More specifically, in the preassembly position, end wall 17 of slide 16 is positioned facing and spaced apart from end wall 10*a* of casing 4 in direction B.

To connect connectors 2 and 3, slide 16 is moved in direction B into a fully-assembled position (FIG. 2), in which lateral walls 18 are housed completely inside main body 6 of casing 4, and end wall 17 is positioned adjacent to end wall 10*a* of casing 4.

Device 15 also comprises an operating lever 29 fitted to casing 4, and which rotates about an axis C, perpendicular to directions A and B, to translate slide 16 in direction B from the preassembly to the fully-assembled position, and so connect connectors 2 and 3 and the terminals of connectors 2 and 3 in direction A.

Lever 29 is advantageously hinged directly to slide 16 at axis C; and actuating means 30 are provided to move axis C and slide 16 in direction B when lever 29 is operated.

More specifically, lever 29 is defined by two contoured arms 31 having first end portions 32 hinged externally, about axis C, to respective opposite lateral walls 18 of slide 16, and second end portions 33 joined by a cross member 34.

To hinge arms 31 of lever 29 to respective lateral walls 18 of slide 16, and also move axis C in direction B to translate slide 16 from the preassembly to the fully-assembled position, each lateral wall 11 of main body 6 of casing 4 has a contoured through opening 35. In the example shown, end portions 32 of arms 31 have respective projecting pins 36 which fit loosely through respective openings 35 in lateral walls 11 of casing 4, and engage in rotary manner respective through holes 37 formed in lateral walls 18 of slide 16.

Connectors 2 and 3 are connected by rotating lever 29 about axis C from a start position (FIG. 1, and the position shown by the dot-and-dash line in FIG. 2) corresponding to the preassembly position of slide 16, i.e. predetermined extraction of slide 16 from main body 6 of casing 4, to an end position (shown by the continuous line in FIG. 2) corresponding to the fully-assembled position of slide 16, i.e. lateral walls 18 of slide 16 inserted completely inside main body 6 of casing 4.

More specifically, in the start position of lever 29, cross member 34 is located adjacent to wall lob of main body 6 of casing 4; and, in the end position of lever 29, cross member 34 is located adjacent to wall 10*a* of main body 6 of casing 4, and engages in known manner a tooth 38 projecting from an end edge of shell 13 at the same end as end wall 10*a*.

In a preferred embodiment of the present invention, actuating means 30 are defined by a toothed coupling 40 between the end portion 32 of each arm 31 of lever 29 and the relative lateral wall 11 of casing 4.

More specifically, end portion 32 of each arm 31 of lever 29 has a circular projection 41, of axis C, from which relative pin 36 projects.

On the side facing shell 13 of casing 4 in use, each projection 41 defines a sector gear 42 which meshes with a rack 43 extending parallel to direction B and formed, adjacent to shell 13, on a lateral edge 44 of opening 35 in relative lateral wall 11 of casing 4.

The rest of projection 41—indicated 45—of each arm 31 is defined by a wall extending parallel to arm 31 and defining, with arm 31, a seat for engaging in sliding manner a raised portion 46 of a lateral edge 47, of relative opening 35, facing edge 44 on which rack 43 is formed.

More specifically, edge 47 of each opening 35 comprises, alongside raised portion 46, a sunken portion 48 defining a step with portion 46, and which does not interfere with lever 29 in the start position.

As lever 29 moves from the start to the end position, raised portion 46 of edge 47 of opening 35 of each lateral wall 11 of casing 4 is engaged between end portion 32 of relative arm 31 and portion 45 of relative projection 41, and acts as a guide for lever 29, to prevent arms 31 being parted by the force required to connect connectors 2 and 3.

Unit 1 is assembled by placing connectors 2 and 3 together in direction A, so that pegs 23 engage inlet portions 25 of relative grooves 22, and then rotating lever 29 from the start to the end position.

As it rotates, sector gears 42 of arms 31 of lever 29 mesh with respective racks 43 on lateral walls 11 of casing 4, so that, given the constraints between lever 29, slide 16, and casing 4, axis C and, therefore, slide 16 are necessarily moved in direction B.

At this stage, raised portion 46 of edge 47 of each opening 35 engages the gap between end portion 32 of relative arm 31 and portion 45 of relative projection 41 to define a guide for guiding the movement of lever 29.

Over the final insertion of slide 16 inside main body 6, relative slide between pegs 23 and sloping intermediate portions 26 of relative grooves 22 connects connectors 2 and 3 in direction A; and the movement of slide 16 is completed by cross member 34 of lever 29 clicking onto tooth 38, which corresponds to the fully-connected position of connectors 2 and 3.

The advantages of connector 2 according to the present invention will be clear from the foregoing description.

In particular, by virtue of hinge axis C of lever 29 moving when connecting connectors 2 and 3, the distance between axis C and tooth 38 for retaining cross member 34 increases when switching from the start to the end position of lever 29, so that the overall length of lever 29 may be greater than if the hinge axis were fixed, as is typically the case in known connectors.

The increase in the overall length of lever 29 drastically reduces the effort required on the part of the user to connect connectors 2 and 3, and is achieved with absolutely no increase in the overall size of connector 2 as compared with known connectors.

Clearly, changes may be made to connector 2 as described herein without, however, departing from the scope of the present invention.

In particular, the toothed coupling 40 between lever 29 and main body 6 of casing 4 may be replaced by other types of couplings, e.g. a cam coupling.

The invention claimed is:

1. An electric connector comprising:

an insulating casing defining a number of cavities for housing respective electric terminals and having axes parallel to a first direction (A) in which said connector is connected to a complementary connector;

a slide fitted to said casing to slide in a second direction (B) perpendicular to said first direction (A), and having cam-type first constraint means for receiving second constraint means on said complementary connector to produce a relative coupling movement between said connectors in said first direction (A) when said slide translates in said second direction (B); and an operating lever rotating about an axis (C) perpendicular to said first and said second direction (A, B), and activated selectively to translate said slide in said second direction (B); characterized in that said lever is hinged to said slide at said axis (C), and in that actuating means are provided to move said axis (C) and said slide in said second direction (B) when said lever is operated, wherein said actuating means comprise coupling means between said lever and said casing, and wherein said coupling means comprise a toothed coupling.

2. A connector as claimed in claim 1, characterized in that said toothed coupling comprises a sector gear on said lever; and a rack on said casing.

3. A connector as claimed in claim 1, characterized in that said slide slides inside said casing, between opposite walls of the casing; and in that said lever extends outside said casing, and comprises hinge means hinging it to said slide, and which extend through respective openings through said walls of said casing.

4. A connector as claimed in claim 3, characterized in that a portion of one edge of each said opening defines a guide for guiding the movement of said lever.

5. An electric connector comprising:

an insulating casing comprising a number of cavities for housing respective electric terminals and having axes parallel to a first direction in which the electric connector is connected to a complementary connector;

a slide fitted to the insulating casing to slide in a second direction generally perpendicular to the first direction, wherein the slide comprises a cam-type first constraint for receiving a second constraint on the complementary connector to produce a relative coupling movement between the connectors in the first direction when the slide translates in the second direction; and an operating lever which is rotatable about an axis generally perpendicular to the first and the second directions, wherein the operating lever is configured to be activated selectively to translate the slide in the second direction; wherein the lever is hinged to the slide at the axis, and wherein an actuating system is provided to move the axis and the slide in the second direction when the lever is operated, wherein the actuating system comprises a coupling system between the lever and the casing, and wherein the coupling system comprise a toothed coupling.

6. An electric connector comprising:

an insulating casing comprising a number of cavities for housing respective electric terminals and having axes parallel to a first direction in which the electric connector is connected to a complementary connector;

a slide fitted to the insulating casing to slide in a second direction generally perpendicular to the first direction, wherein the slide comprises a cam-type first constraint for receiving a second constraint on the complementary connector to produce a relative coupling movement between the connectors in the first direction when the slide translates in the second direction; and an operating lever which is rotatable about an axis generally perpendicular to the first and the second directions, wherein the operating lever is configured to be activated selectively to translate the slide in the second direction; wherein the lever is hinged to the slide at the axis, and wherein an actuating system is provided to move the axis and the slide in the second direction when the lever is operated, wherein the slide is configured to slide inside the casing, between opposite walls of the casing, and wherein the lever extends outside the casing, and comprises a hinge hinging the lever to the slide, and which extend through respective openings through the walls of the casing, wherein a portion of one edge of each of the openings defines a guide for guiding the movement of the lever.

* * * * *